US008863535B2

(12) United States Patent
Chen et al.

(10) Patent No.: US 8,863,535 B2
(45) Date of Patent: Oct. 21, 2014

(54) AIR CONDITIONING APPARATUS AND CONTROL METHOD THEREOF

(75) Inventors: Lee-Long Chen, Taoyuan Hsien (TW); Wu-Chi Li, Taoyuan Hsien (TW); Ya-Sen Tu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 464 days.

(21) Appl. No.: 13/314,318

(22) Filed: Dec. 8, 2011

(65) Prior Publication Data

US 2013/0086931 A1 Apr. 11, 2013

(30) Foreign Application Priority Data

Oct. 7, 2011 (TW) ..... 100136419 A

(51) Int. Cl.
*F25B 1/00* (2006.01)
*F25B 41/00* (2006.01)
*F25B 49/02* (2006.01)

(52) U.S. Cl.
CPC ..... *F25B 41/003* (2013.01); *F25B 2600/0251* (2013.01); *F25B 2400/0401* (2013.01); *F25B 2700/2104* (2013.01); *F25B 2600/2501* (2013.01); *F25B 49/022* (2013.01); *F25B 2400/0411* (2013.01)
USPC ..... 62/115

(58) Field of Classification Search
USPC ..... 62/115, 168, 228.1, 498, 515
See application file for complete search history.

(56) References Cited

U.S. PATENT DOCUMENTS

| | | | | |
|---|---|---|---|---|
| 7,028,706 | B2 * | 4/2006 | Ando | 137/487.5 |
| 2009/0110562 | A1 | 4/2009 | Huang et al. | |
| 2010/0005820 | A1 * | 1/2010 | Harig | 62/228.1 |

FOREIGN PATENT DOCUMENTS

| | | |
|---|---|---|
| CN | 201126229 | 10/2008 |
| CN | 201733563 | 2/2011 |
| TW | 500897 | 9/2002 |
| TW | M406163 | 6/2011 |

OTHER PUBLICATIONS

Office Action from related Taiwanese Appln. No. 100136419 dated Apr. 29, 2014. Summary English translation attached.

* cited by examiner

*Primary Examiner* — Melvin Jones
(74) *Attorney, Agent, or Firm* — Grossman, Tucker, Perreault & Pfleger, PLLC

(57) ABSTRACT

An air conditioning apparatus and a control method thereof are provided. The air conditioning apparatus includes a first switch valve, a compressor, a decompression element, a second switch valve, a condenser, and an evaporator. The control method of an air conditioning apparatus includes steps of setting a preset temperature, measuring an indoor temperature, and comparing the preset temperature with the indoor temperature. When the indoor temperature is lower than the preset temperature, the first switch valve and the second switch valve are turned on and the compressor is turned off; and when the indoor temperature is higher than the preset temperature, the first switch valve and the second switch valve are turned off and the compressor is turned on.

19 Claims, 10 Drawing Sheets

AIR CONDITIONING APPARATUS AND CONTROL METHOD THEREOF

This application claims the benefit of the priority to Taiwan Patent Application No. 100136419 filed on Oct. 7, 2011, and the disclosures of which are incorporated herein by reference in their entirety.

CROSS-REFERENCES TO RELATED APPLICATIONS

Not applicable.

BACKGROUND OF THE INVENTION

1. Field of the Invention

The present invention relates to an air conditioning apparatus and a control method thereof, and more particularly, to an air conditioning apparatus and a control method thereof that is energy-saving.

2. Descriptions of the Related Art

Referring to FIG. 1, there is shown a schematic view of a conventional air conditioning apparatus 1. The air conditioning apparatus 1 comprises a compressor 11, a condenser 12, a condenser fan 13, an evaporator 15, an evaporator fan 16 and a capillary or expansion valve 14. A coolant can circulate through the compressor 11, the condenser 12, the capillary (or expansion valve 14) and the evaporator 15. The condenser fan 13 is disposed on a side of the condenser 12, and the evaporator fan 16 is disposed on a side of the evaporator 15. As the above components of the conventional air conditioning apparatus are well known to those of ordinary skill in the air conditioning field, no further description will be made again herein.

The conventional air conditioning apparatus 1 may be of a frequency-conversion type or a non-frequency-conversion type depending on the type of the compressor 11 thereof. If the air conditioning apparatus 1 is of the non-frequency-conversion type, an alternating current is used for the compressor 11, and the compressor 11 operates at a constant rotating speed. Once an indoor temperature reaches a preset temperature set by a user, the compressor 11 is turned off and then circulation of the coolant will stop so that heat in the indoor environment will not be further absorbed by the air conditioning apparatus. Thus, the indoor temperature will rise quickly to cause the compressor 11 to be turned on again. However, turning on and off the compressor 11 within a short time consumes much electric energy and also shortens the service life of the compressor 11.

If the air conditioning apparatus 1 is of the frequency-conversion type, a direct current may be used for the compressor 11, and the rotating speed of the compressor 11 can be adjusted. When the indoor temperature reaches the preset temperature set by the user, the rotating speed of the compressor 11 decreases to reduce the consumption of electric energy. As the compressor 11 is still in operation to circulate the coolant, the air conditioning apparatus 1 can still absorb the heat from the indoor environment so that the indoor temperature will not rise quickly. However, when the indoor temperature is lower than the preset temperature, a certain amount of electric energy is still consumed by the air conditioning apparatus 1 of the frequency-conversion type because the compressor 11 thereof is still in operation.

SUMMARY OF THE INVENTION

The primary objective of the present invention is to provide an air conditioning apparatus and a control method thereof, which enables the air conditioning apparatus to absorb heat from an indoor environment even when the compressor is turned off so as to save energy.

To achieve the aforesaid objective, the present invention provides an air conditioning apparatus, comprising: a first switch valve; a compressor, which is connected with the first switch valve in parallel; a decompression element; a second switch valve, which is connected with the decompression element in parallel; a condenser, which is connected with the compressor and the first switch valve; and an evaporator, which is connected with the second switch valve and the decompression element. When an indoor temperature is lower than a preset temperature of the air conditioning apparatus, the first switch valve and the second switch valve are turned on, and the compressor is turned off; and when the indoor temperature is higher than the preset temperature, the first switch valve and second switch valve are turned off, and the compressor is turned on.

The air conditioning apparatus further comprises a condenser fan disposed on a side of the condenser and an evaporator fan disposed on a side of the evaporator.

Preferably, the air conditioning apparatus further comprises a controller electrically connected with the first switch valve, the second switch valve and the compressor.

In addition, the air conditioning apparatus further comprises a temperature sensor disposed on the other side of the evaporator and electrically connected with the controller.

Preferably, an installation location of the condenser is higher than an installation location of the evaporator, or the installation location of the condenser partially overlaps the installation location of the evaporator. More preferably, a lowermost side of the condenser is at a same height as an uppermost side of the evaporator.

Preferably, each of the first switch valve and the second switch valve is an electro-magnetic switch valve.

Furthermore, the air conditioning apparatus further comprises a refrigerant which circulates through the compressor, the condenser, the decompression element, the first switch valve, the second switch valve and the evaporator. And the refrigerant is a coolant, R410, R134 or R22.

Preferably, the decompression element is a capillary or an expansion valve.

An input end of the first switch valve is connected with an end of a first pipeline, and an output end of the first switch valve is connected with an end of a second pipeline; an input end of the compressor is connected with an end of a third pipeline, and an output end of the compressor is connected with an end of a fourth pipeline; an input end of the decompression element is connected with an end of a fifth pipeline, and an output end of the decompression element is connected with an end of a sixth pipeline; an input end of the second switch valve is connected with an end of a seventh pipeline, and an output end of the second switch valve is connected with an end of an eighth pipeline; an input end of the condenser is connected with the other end of the second pipeline and the other end of the fourth pipeline, and an output end of the condenser is connected with the other end of the fifth pipeline and the other end of the seventh pipeline; an input end of the evaporator is connected with the other end of the sixth pipeline and the other end of the eighth pipeline, and an output end of the evaporator is connected with the other end of the first pipeline and the other end of the third pipeline. Preferably, each of the aforesaid pipelines is a hollow copper tube, aluminum tube or metal tube.

A diameter of the first pipeline is larger than a diameter of the third pipeline or a diameter of the fourth pipeline; a diameter of the second pipeline is larger than the diameter of the third pipeline or the diameter of the fourth pipeline; a diameter of the seventh pipeline is larger than a diameter of the fifth pipeline or a diameter of the sixth pipeline; a diameter of the eighth pipeline is larger than the diameter of the fifth pipeline or the diameter of the sixth pipeline.

To achieve the aforesaid objective, the present invention further provides a control method of an air conditioning apparatus. The air conditioning apparatus comprises a first switch valve, a compressor, a decompression element, a second switch valve, a condenser and an evaporator. The control method comprises steps of: setting a preset temperature, measuring an indoor temperature, comparing the preset temperature with the indoor temperature, turning on the first switch valve and the second switch and turning off the compressor when the indoor temperature is lower than the preset temperature; and turning off the first switch valve and the second switch valve and turning on the compressor when the indoor temperature is higher than the preset temperature. The preset temperature is higher than an outdoor temperature and is preferably 40 degrees Celsius to 50 degrees Celsius.

When the indoor temperature is lower than the preset temperature, a first circulating loop through the evaporator, the first switch valve, the condenser, the second switch valve, and back to the evaporator is formed; and when the indoor temperature is higher than the preset temperature, a second circulating loop through the evaporator, the compressor, the condenser, the decompression element, and back to evaporator is formed. The first circulating loop is integrated with the second circulating loop by a controller. Each of the evaporator and the condenser is provided with a fan, and the controller controls the compressor, the fan of the condenser, the fan of the evaporator, the first switch valve and the second valve.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 2A:
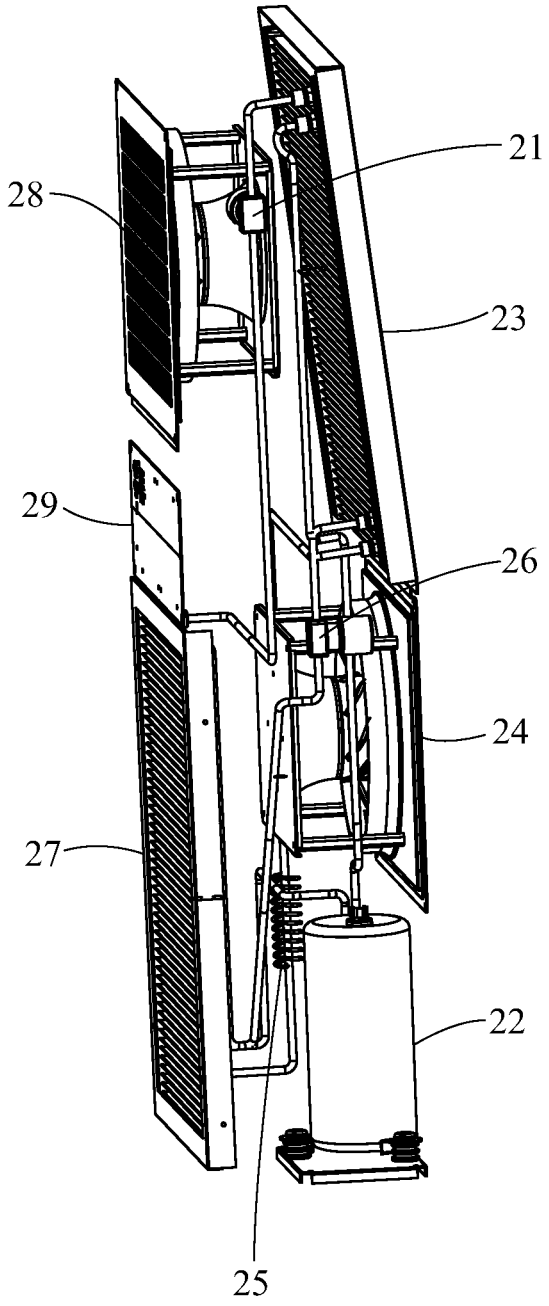
FIG. 2*a* is a perspective structural view of a preferred embodiment of an air conditioning apparatus according to the present invention.
Figure 2B:
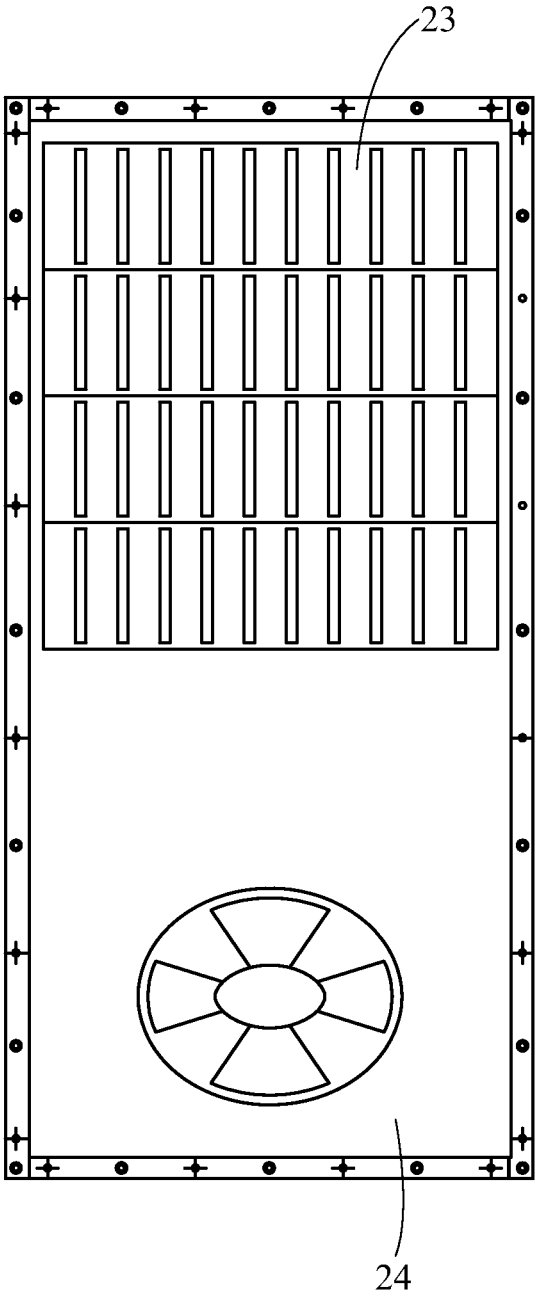
FIG. 2*b* is a schematic view of a condenser and a condenser fan of the air conditioning apparatus shown in FIG. 2*a;*
Figure 2C:
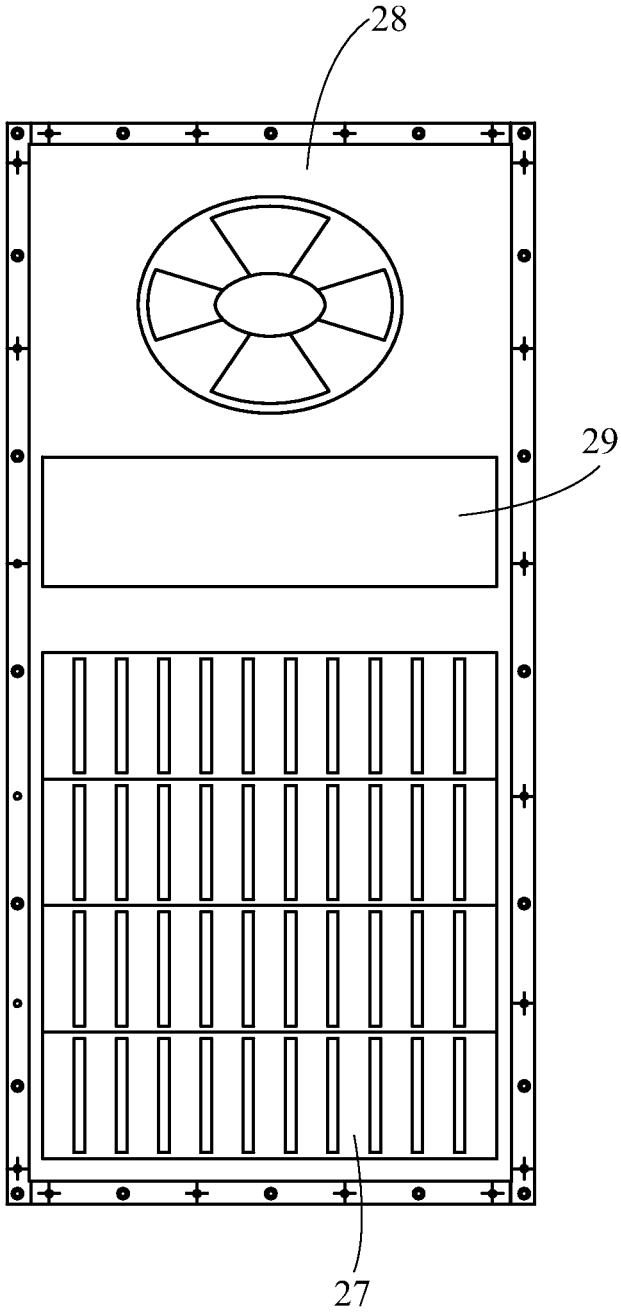
FIG. 2*c* is a schematic view of an evaporator and an evaporator fan of the air conditioning apparatus shown in FIG. 2*a;*
Figure 2D:
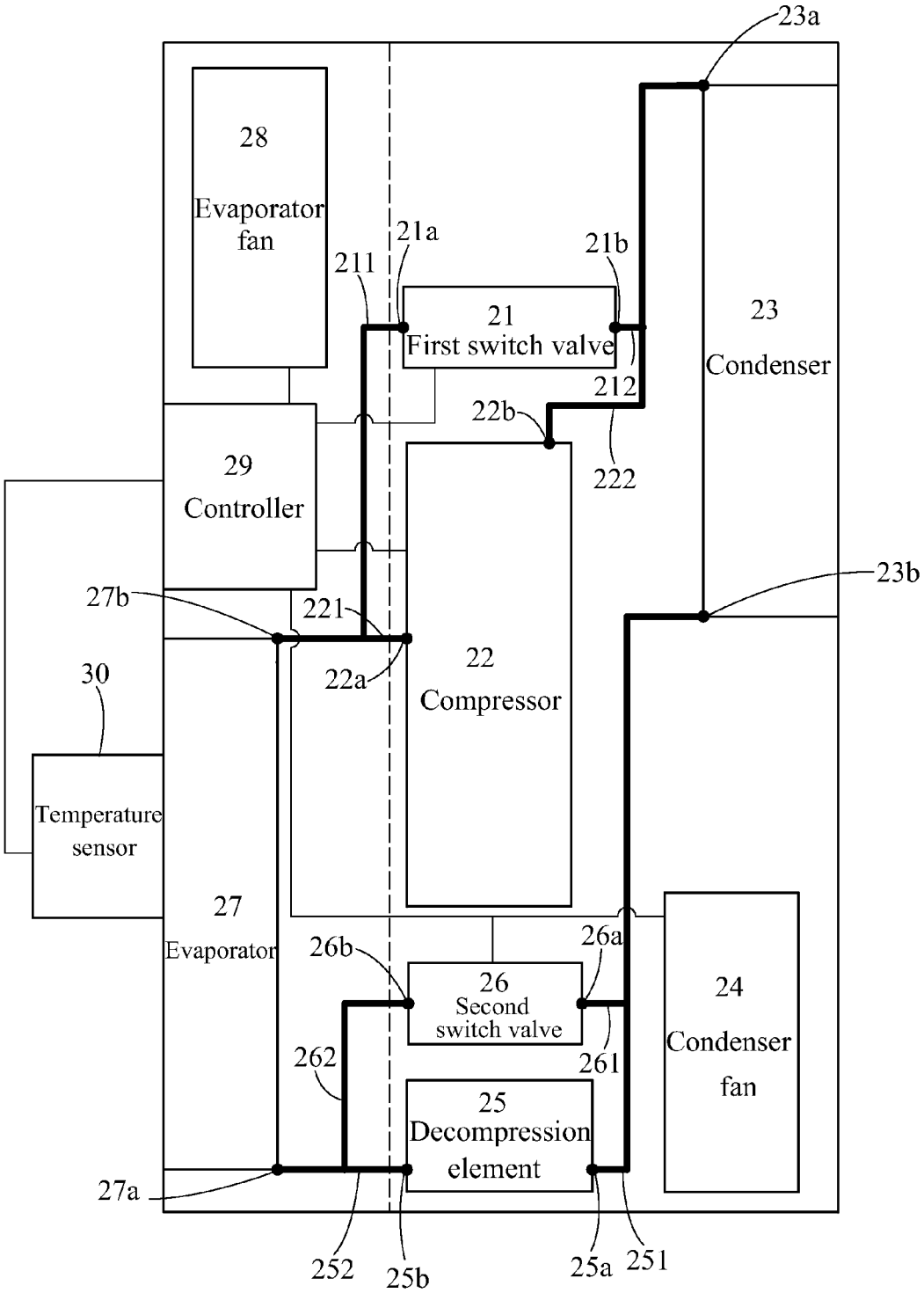
FIG. 2*d* is a block diagram of the preferred embodiment of the air conditioning apparatus according to the present invention shown in FIG. 2*a;*

Referring to FIG. 2*a*, FIG. 2*b*, FIG. 2*c* and FIG. 2*d*, FIG. 2*a* is a perspective structural view of a preferred embodiment of an air conditioning apparatus according to the present invention; FIG. 2*b* is a schematic view of a condenser and a condenser fan of the air conditioning apparatus shown in FIG. 2*a*; FIG. 2*c* is a schematic view of an evaporator and an evaporator fan of the air conditioning apparatus shown in FIG. 2*a*; and FIG. 2*d* is a block diagram of the preferred embodiment of the air conditioning apparatus according to the present invention as shown in FIG. 2*a*.

Specifically, the air conditioning apparatus may comprise a first switch valve 21, a compressor 22, a condenser 23, a condenser fan 24, a decompression element 25, a second switch valve 26, an evaporator 27, an evaporator fan 28 and a controller 29.

The controller 29 may be electrically connected with the first switch valve 21, the compressor 22, the condenser fan 24, the second switch valve 26 and the evaporator fan 28 to control turning on or off of the first switch valve 21, the compressor 22, the condenser fan 24, the second switch valve 26 and the evaporator fan 28 respectively.

An input end 21*a* of the first switch valve 21 is connected with an end of a first pipeline 211, and an output end 21*b* of the first switch valve 21 is connected with an end of a second pipeline 212. The first switch valve 21 may be an electromagnetic switch valve.

An input end 22*a* of the compressor 22 is connected with an end of a third pipeline 221, and an output end 22*b* of the compressor 22 is connected with an end of a fourth pipeline 222. The compressor 22 is connected with the first switch valve 21 in parallel. The decompression element 25 may be a capillary or an expansion valve. An input end 25*a* of the decompression element 25 is connected with an end of a fifth pipeline 251, and an output end 25*b* of the decompression element 25 is connected with an end of a sixth pipeline 252.

An input end 26*a* of the second switch valve 26 is connected with an end of a seventh pipeline 261, and an output end 26*b* of the second switch valve 26 is connected with an end of an eighth pipeline 262. The second switch valve 26 may also be an electro-magnetic switch valve. The decompression element 25 is connected with the second switch valve 26 in parallel.

An input end 23*a* of the condenser 23 is connected with the other end of the second pipeline 212 and the other end of the fourth pipeline 222, and an output end 23*b* of the condenser 23 is connected with the other end of the fifth pipeline 251 and the other end of the seventh pipeline 261. In addition, the condenser fan 24 may be disposed on a side of the condenser 23. In this embodiment, the condenser fan 24 is disposed on a lower side of the condenser 23.

An input end 27*a* of the evaporator 27 is connected with the other end of the sixth pipeline 252 and the other end of the eighth pipeline 262, and an output end 27*b* of the evaporator 27 is connected with the other end of the first pipeline 211 and the other end of the third pipeline 221. Furthermore, the evaporator fan 28 is disposed on a side of the evaporator 27, and in this embodiment, is disposed on an upper side of the evaporator 27.

A temperature sensor 30 is disposed on the other side of the evaporator 27 to measure an indoor temperature. The temperature sensor 30 is also electrically connected with the controller 29 to transmit the measured temperature information to the controller 29.

An installation location of the condenser 23 may be higher than an installation location of the evaporator 27 (i.e., a lowermost side of the condenser 23 is higher than an uppermost side of the evaporator 27), or the installation location of the condenser 23 partially overlaps the installation location of the evaporator 27 (i.e., the lowermost side of the condenser 23 may be lower than the uppermost side of the evaporator 27 but higher than a lowermost side of the evaporator 27). Alternatively, the lowermost side of the condenser 23 and the uppermost side of the evaporator 27 may also be at the same height. Thus, when condensed into liquid in the condenser 23, a refrigerant can flow down into the evaporator 27 because of the gravitation. The refrigerant may be a coolant such as R410, R134 or R22.

A diameter of the first pipeline 211 may be larger than a diameter of the third pipeline 221 or a diameter of the fourth pipeline 222; a diameter of the second pipeline 212 may be larger than the diameter of the third pipeline 221 or the diameter of the fourth pipeline 222; a diameter of the seventh pipeline 261 may be larger than a diameter of the fifth pipeline 251 or a diameter of the sixth pipeline 252; and a diameter of the eighth pipeline 262 may be larger than the diameter of the fifth pipeline 251 or the diameter of the sixth pipeline 252. Thus, when the refrigerant flows through the first pipeline 211, the second pipeline 212, the seventh pipeline 261 and the eighth pipeline 262 which have a larger diameter, the resistance to flow will be relatively small.

In this embodiment, the diameter of the first pipeline 211 is larger than both the diameter of the third pipeline 221 and the diameter of the fourth pipeline 222; the diameter of the second pipeline 212 is larger than both the diameter of the third pipeline 221 and the diameter of the fourth pipeline 222; the diameter of the seventh pipeline 261 is larger than both the diameter of the fifth pipeline 251 and the diameter of the sixth pipeline 252; and the diameter of the eighth pipeline 262 is larger than both the diameter of the fifth pipeline 251 and the diameter of the sixth pipeline 252. Each of the aforesaid pipelines may be a hollow copper tube, a hollow aluminum tube or a hollow metal tube.

According to the aforesaid connections among and arrangements of the components of the air conditioning apparatus, the refrigerant in the air conditioning apparatus may have at least two kinds of circulation sequences. A first one of the sequences is to circulate through the evaporator 27, the compressor 22, the condenser 23 and the decompression element 25 in sequence, and a second one is to circulate through the evaporator 27, the first switch valve 21, the condenser 23 and the second switch valve 26 in sequence. The air conditioning apparatus of this embodiment can become more energy-saving than conventional air conditioning apparatuses of the frequency-conversion type or the non-frequency-conversion type by switching between the two kinds of circulation sequences.

Figure 3A:
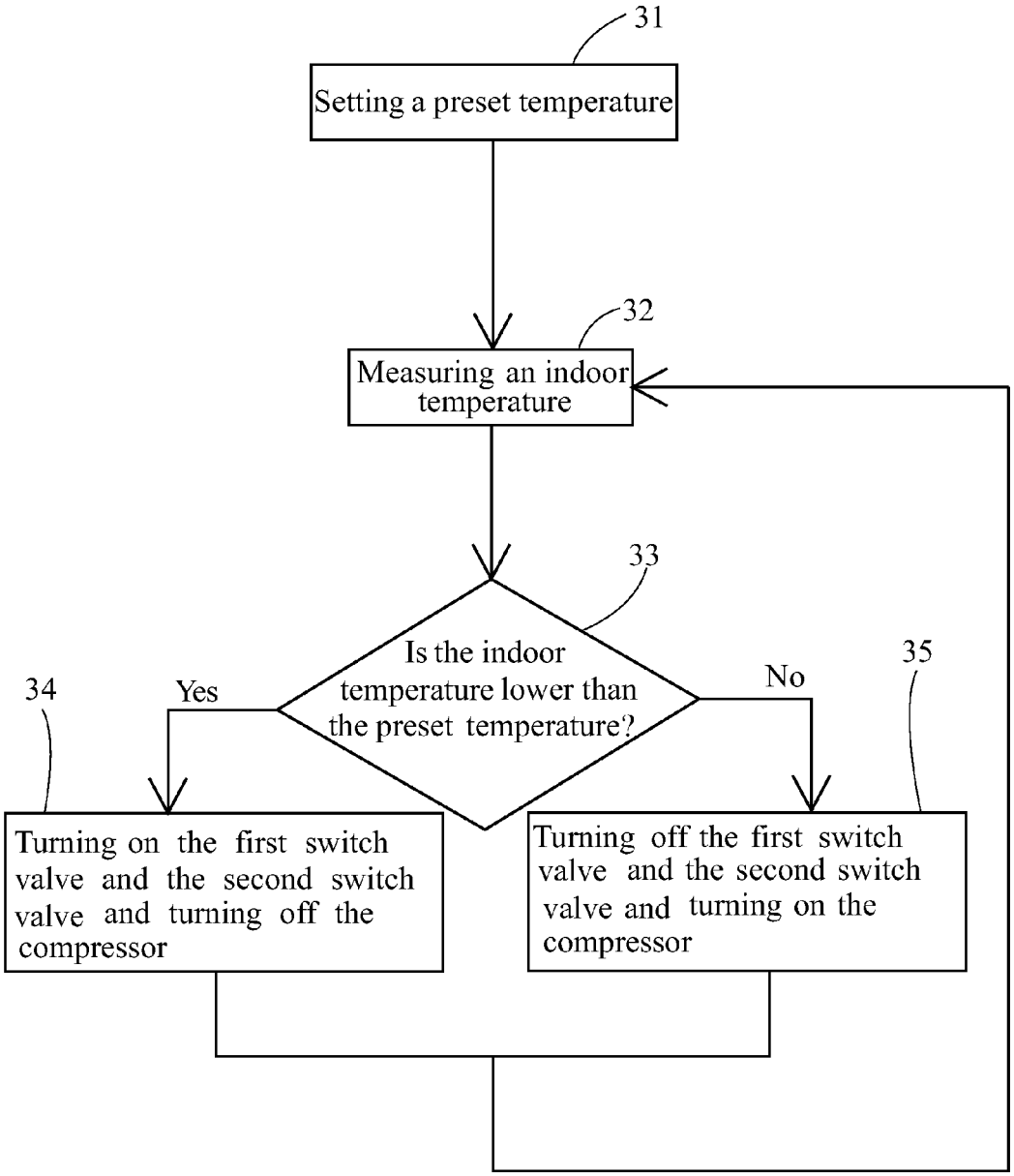
FIG. 3*a* is a flowchart diagram illustrating steps of a preferred embodiment of a control method of an air conditioning apparatus according to the present invention.

How the air conditioning apparatus of this embodiment switches between the two kinds of circulation sequences will be further described hereinafter; i.e., a preferred embodiment of a control method of the air conditioning apparatus according to the present invention will be described. Referring to FIG. 3*a* and FIG. 2*d* together, FIG. 3*a* is a flowchart diagram of steps of the preferred embodiment of the control method of the air conditioning apparatus according to the present invention.

Firstly, a preset temperature may be set by a user in advance and recorded by the controller 29 (step 31). The preset temperature must be higher than an outdoor temperature; for example, the preset temperature may be 40 degrees Celsius to 50 degrees Celsius. Next, the temperature sensor 30 continuously or intermittently measures the indoor temperature and transmits the measured indoor temperature to the controller 29 (step 32). The controller 29 then compares the preset temperature with the measured indoor temperature continuously or intermittently (step 33).

Figure 3B:
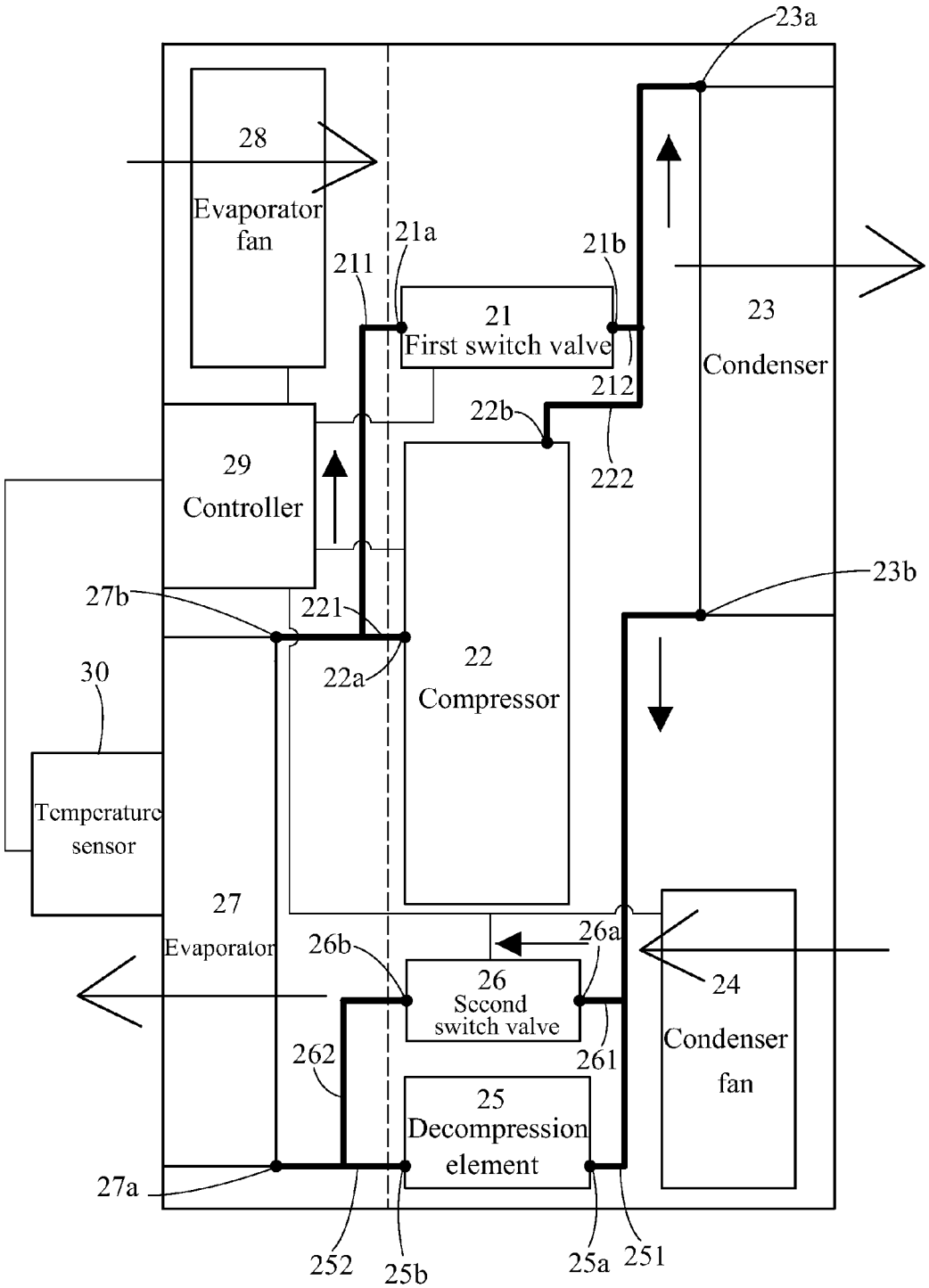
FIG. 3*b* is a schematic view illustrating a flowing state of a refrigerant in the air conditioning apparatus shown in FIG. 2*d;*

When the controller 29 determines that the indoor temperature is lower than the preset temperature, it means that the current indoor temperature meets the user's requirement and, then, the compressor 22 is turned off and the first switch valve 21 and the second switch valve 26 are turned on by the controller 29 (step 34). Referring to FIG. 3*b*, there is shown a schematic view illustrating a flowing state of a refrigerant in the air conditioning apparatus shown in FIG. 2*d*. The refrigerant here circulates in a first circulating loop formed by the evaporator 27, the first switch valve 21, the condenser 23 and the second switch valve 26 in sequence.

In detail, the refrigerant is gasified into gas after absorbing heat from the indoor environment in the evaporator 27, and then the gas rises and passes into the condenser 23 through the first switch valve 21 which has been turned on. Then, the refrigerant is condensed into liquid in the condenser 23 and flows into the evaporator 27 through the second switch valve 26 which has been turned on. According to the above description, the installation location of the condenser 23 is at least partially higher than the installation location of the evaporator 27, so the liquid refrigerant can flow down into the evaporator 27 by means of the gravitation.

It shall be appreciated that, although the refrigerant is not compressed and decompressed significantly after flowing through the first switch valve 21 and the second switch valve 26 respectively, the refrigerant can still absorb a certain amount of heat from the indoor environment so that rise of the indoor temperature is slowed down or restrained.

Furthermore, when flowing into the evaporator 27 from the condenser 23, a portion of the refrigerant may flow through the decompression element 25. However, as the flow resistance in the decompression element 25 is relatively large, only a small portion of the refrigerant flows through the decompression element 25 while most of the refrigerant flows through the second switch valve 26.

Figure 3C:
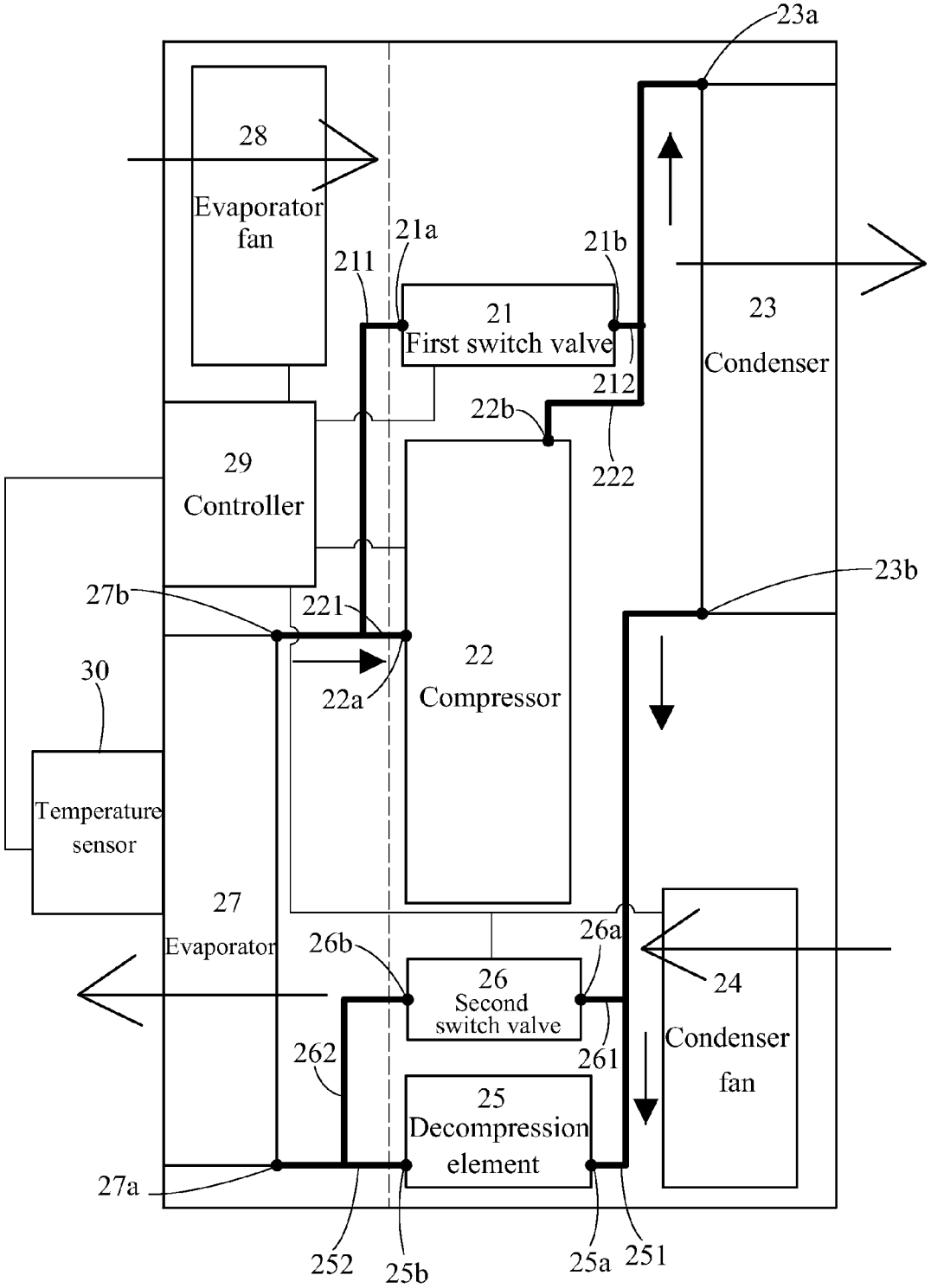
FIG. 3*c* is a schematic view illustrating another flowing state of the refrigerant in the air conditioning apparatus shown in FIG. 2*d;*

When the controller 29 determines that the indoor temperature is higher than the preset temperature, it means that the current indoor temperature may cause the user to feel uncomfortable or cause damage to or degrade objects (such as electronic products) in the indoor environment. Then, the compressor 22 is turned on and the first switch valve 21 and the second switch valve 26 are turned off by the controller 29 (step 35). Referring to FIG. 3*c*, FIG. 3*c* is a schematic view illustrating another flowing state of the refrigerant in the air conditioning apparatus shown in FIG. 2*d*. The refrigerant here circulates in a second circulating loop formed by the evaporator 27, the compressor 22, the condenser 23 and the decompression element 25 in sequence.

Specifically, the refrigerant is gasified into gas after absorbing heat from the indoor environment in the evaporator 27 and then flows into the compressor 22; next, the refrigerant 22 is compressed into a high-temperature and high-pressure gas by the compressor 22 and flows into the condenser 23; and the refrigerant is condensed into liquid in the condenser 23 and then flows into the evaporator 27 through the decompression element 25. Because the refrigerant can be compressed and decompressed by the compressor 22 and the decompression element 25 respectively to a great extent, the refrigerant can absorb a large amount of heat from the indoor environment so as to decrease the indoor temperature to the preset temperature quickly.

It shall be appreciated that, as the first switch valve 21 and the second switch valve 26 are turned off, the refrigerant which has been compressed by the compressor 22 will not flow back to the evaporator 27 through the first switch valve 21, and the refrigerant which has been condensed will also not flow into the evaporator 27 through the second switch valve 26.

The steps 32 to 35 of the aforesaid control method can be carried out repeatedly, and in the process of carrying out the aforesaid steps repeatedly, the condenser fan 24 and the evaporator fan 28 can operate continuously no matter whether the indoor temperature is higher than the preset temperature or not. In this way, the refrigerant can dissipate heat in the condenser 23 and absorb heat in the evaporator 27 quickly.

Figure 1:
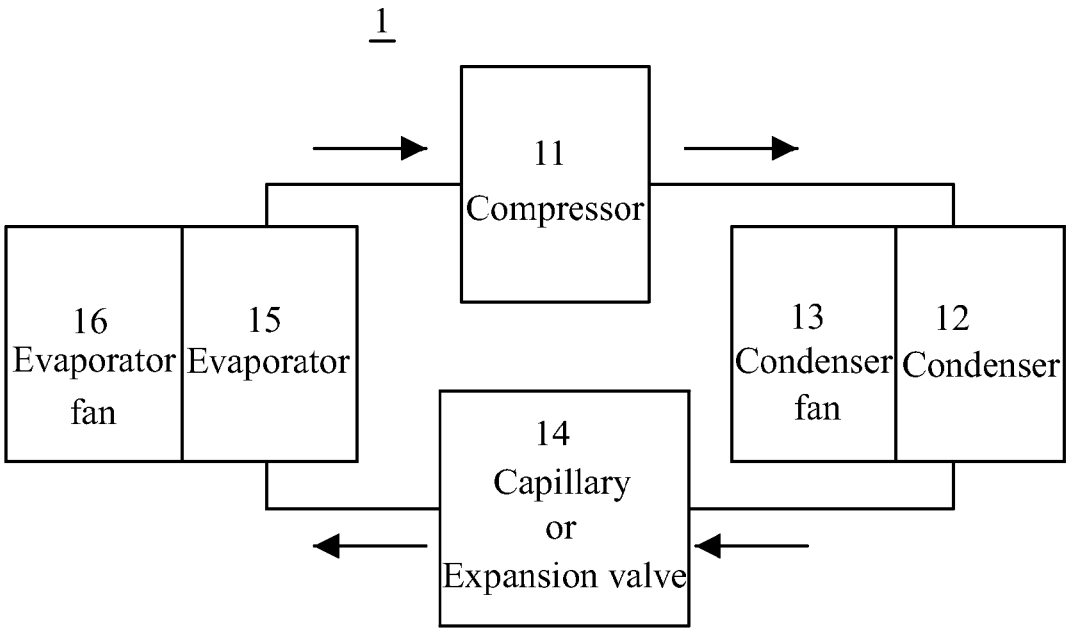
FIG. 1 is a schematic view of a conventional air conditioning apparatus.
Figure 4A:
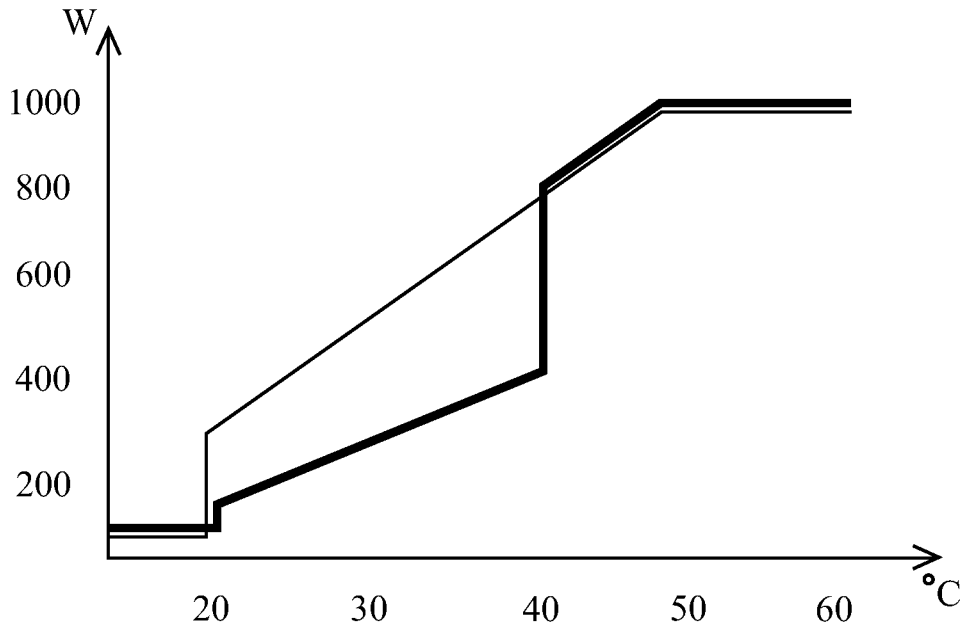
FIG. 4*a* is a graph of temperature versus power of the air conditioning apparatus shown in FIG. 2*a* and that of a conventional air conditioning apparatus of the frequency-conversion type.

Referring to FIG. 4*a* together with FIG. 1 and FIG. 2*d*, FIG. 4*a* is a graph of temperature versus power of the air conditioning apparatus shown in FIG. 2*a* and a conventional air conditioning apparatus of the frequency-conversion type. In FIG. 4*a*, the bold line represents the relationship of temperature versus power of the air conditioning apparatus of the frequency-conversion type, and the fine line represents the relationship of temperature versus power of the air conditioning apparatus of the preferred embodiment.

The compressor 11 of the conventional air conditioning apparatus of the frequency-conversion type operates all the time no matter whether the indoor temperature is lower than the preset temperature or not. However, in the air conditioning apparatus of this embodiment, the compressor 22 is turned off and only the condenser fan 24 and the evaporator fan 28 consume electric energy when the indoor temperature is lower than the preset temperature (e.g., 40 degrees Celsius); and when the indoor temperature is higher than the preset temperature, the compressor 22 is turned on and also consumes electric energy in addition to the condenser fan 24 and the evaporator fan 28.

As shown in FIG. 4*a*, when the indoor temperature is higher than the preset temperature, the operation power of the air conditioning apparatus of the preferred embodiment is nearly the same as that of the conventional air conditioning apparatus of the frequency-conversion type. However, when the indoor temperature is lower than the preset temperature, the operation power of the air conditioning apparatus of the preferred embodiment is obviously much smaller than that of the conventional air conditioning apparatus of the frequency-conversion type by about 50%. Furthermore, the compressor 22 of this embodiment only operates when the indoor temperature is higher than the preset temperature, so the operating time of the compressor 22 is shortened, which helps to prolong the service life of the compressor 22.

Figure 4B:
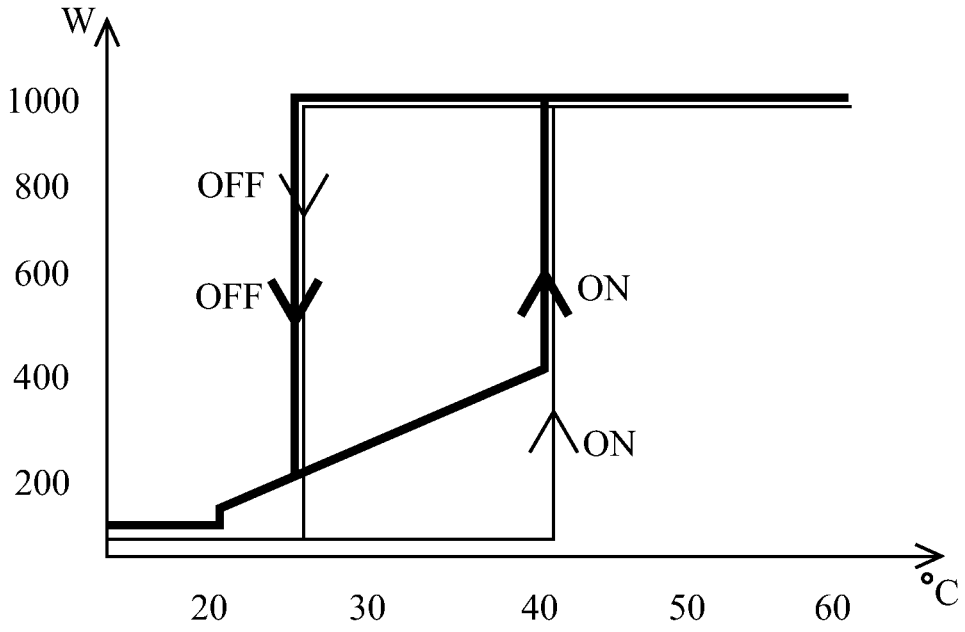
FIG. 4*b* is a graph of temperature versus power of the air conditioning apparatus shown in FIG. 2*a* and that of a conventional air conditioning apparatus of the non-frequency-conversion type.

Referring to FIG. 4*b* together with FIG. 1 and FIG. 2*d*, FIG. 4*b* is a graph of temperature versus power of the air conditioning apparatus shown in FIG. 2*a* and a conventional air conditioning apparatus of the non-frequency-conversion type. In FIG. 4*b*, the bold line represents the relationship of temperature versus power of the conventional air conditioning apparatus of the non-frequency-conversion type, and the fine line represents the relationship of temperature versus power of the air conditioning apparatus of this embodiment.

When the indoor temperature is lower than the preset temperature (e.g., 40 degrees Celsius), the compressor 11 of the conventional air conditioning apparatus of the non-frequency-conversion type and the compressor 22 of the air conditioning apparatus of the preferred embodiment are both turned off; and when the indoor temperature is higher than the preset temperature, the compressor 11 of the conventional air conditioning apparatus of the non-frequency-conversion type and the compressor 22 of the air conditioning apparatus of this embodiment are both turned on.

However, the compressor 11 of the conventional air conditioning apparatus of the non-frequency-conversion type can not absorb heat from the indoor environment when being turned off, so the indoor temperature will rise quickly to cause the compressor 11 to be turned on again within a short time. In contrast, when the compressor 22 of the air conditioning apparatus of this embodiment is turned off, the refrigerant can still circulate in the air conditioning apparatus, so the air conditioning apparatus can still absorb heat from the indoor environment continuously to slow down the rise of the indoor temperature. Thus, an interval between a turning-off and a next turning-on of the compressor 22 of the air conditioning apparatus of this embodiment can be extended, and the times of turning on and off are reduced by at least more than a half. In this way, the service life of the compressor 22 is prolonged by at least twice.

Referring back to FIG. 2*a*, the air conditioning apparatus of this embodiment is suitable for use in a totally-enclosed machine room or cabinet, because an internal temperature of the totally-enclosed machine room or cabinet may be higher than the outdoor temperature. Furthermore, the air conditioning apparatus of this embodiment may serve as a door leaf of the machine room or the cabinet with the condenser 23 being disposed outside the machine room and the evaporator 27 being disposed inside the machine room. When being installed with the air conditioning apparatus of this embodiment, the machine room or the cabinet can still be totally-enclosed to preventing entry of water vapor and dust.

The air conditioning apparatus of this embodiment may also be implemented as a split-type air conditioning apparatus with the condenser 23 being disposed outside on the roof or at a high location and the evaporator 27 being disposed inside, so that the installation location of the condenser 23 can be higher than the installation location of the evaporator 27.

According to the above descriptions, the air conditioning apparatus and the control method thereof can enable the compressor to stop operating and consuming electric energy when the indoor temperature is lower than the preset temperature so as to save energy. In addition, the air conditioning apparatus and the control method thereof can enable the refrigerant to still absorb heat from the indoor environment by circulating in the air conditioning apparatus when the compressor is turned off so as to slow down or restrain the rise of the indoor temperature. Thereby, the turn-off time of the compressor is extended and the service life of the compressor is prolonged significantly.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An air conditioning apparatus comprising:

a first switch valve;

a compressor, connected with the first switch valve in parallel;

a decompression element;

a second switch valve, connected with the decompression element in parallel;

a condenser, connected with the compressor and the first switch valve; and an evaporator, connected with the second switch valve and the decompression element, wherein when an indoor temperature is lower than a preset temperature of the air conditioning apparatus, the first switch valve and the second switch valve are turned on, and the compressor is turned off; and when the indoor temperature is higher than the preset temperature, the first switch valve and the second switch valve are turned off, and the compressor is turned on.

2. The air conditioning apparatus as claimed in claim 1, further comprising a condenser fan disposed on a side of the condenser.

3. The air conditioning apparatus as claimed in claim 1, further comprising an evaporator fan disposed on a side of the evaporator.

4. The air conditioning apparatus as claimed in claim 1, further comprising a controller electrically connected with the first switch valve, the second switch valve and the compressor.

5. The air conditioning apparatus as claimed in claim 4, further comprising a temperature sensor disposed on another side of the evaporator, and electrically connected with the controller.

6. The air conditioning apparatus as claimed in claim 1, wherein an installation location of the condenser is higher than an installation location of the evaporator, or the installation location of the condenser partially overlaps the installation location of the evaporator.

7. The air conditioning apparatus as claimed in claim 1, wherein a lowermost side of the condenser is at a same height as an uppermost side of the evaporator.

8. The air conditioning apparatus as claimed in claim 1, wherein each of the first switch valve and the second switch valve is an electro-magnetic switch valve.

9. The air conditioning apparatus as claimed in claim 1, further comprising a refrigerant which circulates through the compressor, the condenser, the decompression element, the first switch valve, the second switch valve and the evaporator.

10. The air conditioning apparatus as claimed in claim 9, wherein the refrigerant is a coolant, R410, R134 or R22.

11. The air conditioning apparatus as claimed in claim 1, wherein the decompression element is a capillary or an expansion valve.

12. The air conditioning apparatus as claimed in claim 1, wherein an input end of the first switch valve is connected with an end of a first pipeline, and an output end of the first switch valve is connected with an end of a second pipeline; an input end of the compressor is connected with an end of a third pipeline, and an output end of the compressor is connected with an end of a fourth pipeline; an input end of the decompression element is connected with an end of a fifth pipeline, and an output end of the decompression element is connected with an end of a sixth pipeline; an input end of the second switch valve is connected with an end of a seventh pipeline, and an output end of the second switch valve is connected with an end of an eighth pipeline; an input end of the condenser is connected with another end of the second pipeline and another end of the fourth pipeline, and an output end of the condenser is connected with another end of the fifth pipeline and another end of the seventh pipeline; an input end of the evaporator is connected with another end of the sixth pipeline and another end of the eighth pipeline, and an output end of the evaporator is connected with another end of the first pipeline and another end of the third pipeline.

13. The air conditioning apparatus as claimed in claim 12, wherein each of the first pipeline to the eighth pipeline is a hollow copper tube, aluminum tube or metal tube.

14. The air conditioning apparatus as claimed in claim 12, wherein a diameter of the first pipeline is larger than a diameter of the third pipeline or a diameter of the fourth pipeline; a diameter of the second pipeline is larger than the diameter of the third pipeline or the diameter of the fourth pipeline; a diameter of the seventh pipeline is larger than a diameter of the fifth pipeline or a diameter of the sixth pipeline; a diameter of the eighth pipeline is larger than the diameter of the fifth pipeline or the diameter of the sixth pipeline.

15. A control method of an air conditioning apparatus, wherein the air conditioning apparatus comprises a first switch valve, a compressor, a decompression element, a second switch valve, a condenser and an evaporator, the control method comprising steps of:

setting a preset temperature;

measuring an indoor temperature;

comparing the preset temperature with the indoor temperature;

turning on the first switch valve and the second switch valve and turning off the compressor when the indoor temperature is lower than the preset temperature; and turning off the first switch valve and the second switch valve and turning on the compressor when the indoor temperature is higher than the preset temperature.

16. The control method as claimed in claim 15, wherein the preset temperature is higher than an outdoor temperature.

17. The control method as claimed in claim 16, wherein the preset temperature is 40 degrees Celsius to 50 degrees Celsius.

18. The control method as claimed in claim 15, wherein when the indoor temperature is lower than the preset temperature, a first circulating loop through the evaporator, the first switch valve, the condenser, the second switch valve, and back to the evaporator is formed; and when the indoor temperature is higher than the preset temperature, a second circulating loop through the evaporator, the compressor, the condenser, the decompression element, and back to the evaporator is formed.

19. The control method as claimed in claim 18, wherein the first circulating loop is integrated with the second circulating loop by a controller, each of the evaporator and the condenser is provided with a fan, and the controller controls the compressor, the fan of the condenser, the fan of the evaporator, the first switch valve and the second switch valve.

* * * * *